US005655721A

United States Patent [19]

Matsuoka

[11] Patent Number: 5,655,721

[45] Date of Patent: Aug. 12, 1997

[54] YARN TENSION DEVICE

[75] Inventor: Koichi Matsuoka, Nara-ken, Japan

[73] Assignee: Yamagata Gravure Co., Ltd., Osaka-fu, Japan

[21] Appl. No.: 443,195

[22] Filed: May 17, 1995

[30] Foreign Application Priority Data

May 19, 1994 [JP] Japan ..... 6-130947
Jan. 20, 1995 [JP] Japan ..... 7-025956

[51] Int. Cl.[6] ..... B65H 59/22; B65H 23/08

[52] U.S. Cl. ..... 242/150 R; 226/195

[58] Field of Search ..... 242/150 R, 149; 226/195

[56] References Cited

U.S. PATENT DOCUMENTS

| | | | |
|---|---|---|---|
| 3,459,389 | 8/1969 | Wildi et al. | 242/150 R |
| 3,472,190 | 10/1969 | Gegauf | 242/150 R X |
| 4,175,718 | 11/1979 | Derichs et al. | 242/150 R |
| 4,202,511 | 5/1980 | Koslowski | 242/150 R |
| 4,272,038 | 6/1981 | Wildi | 242/150 R |
| 4,535,609 | 8/1985 | Goller et al. | 242/150 R X |
| 4,548,369 | 10/1985 | Bossart | 242/150 R |
| 4,572,459 | 2/1986 | Kamp et al. | 242/150 R |
| 4,725,015 | 2/1988 | Zitzen | 242/150 R |

FOREIGN PATENT DOCUMENTS

| | | |
|---|---|---|
| 50-13236 | 5/1948 | Japan . |
| 50-145831 | 5/1949 | Japan . |
| 55-70668 | 5/1980 | Japan . |
| 62-12585 | 1/1987 | Japan . |

*Primary Examiner*—Michael Mansen
*Attorney, Agent, or Firm*—Sixbey, Friedman, Leedom & Ferguson, PC; David S. Safran

[57] ABSTRACT

A yarn tension device includes a receiving plate and a pushing plate for clamping a moving yarn and a spring for urging the pushing plate toward the receiving plate; at least one of the receiving plate and the pushing plate is rotatably supported, a drive source drives the rotatable plate, and as a result the device can be maintenance-free.

5 Claims, 8 Drawing Sheets

YARN TENSION DEVICE

BACKGROUND OF THE INVENTION

1. Field of the Invention

This invention relates to a yarn tension device for applying a tension to a moving yarn supplied to a knitting or weaving apparatus such as a knitting machine, a loom or the like.

2. Related Art

Conventionally, in a knitting machine for knitting socks, sweaters or the like, numerous yarns are severally supplied to the knitting machine through yarn tension devices.

A conventional yarn tension device includes a receiving plate and a pushing plate for clamping a moving yarn, a spring for urging the pushing plate toward the receiving plate and an adjusting means for adjusting the elastic force of the spring. The moving yarn is clamped between the receiving plate and the pushing plate and a predetermined tension is applied thereto by the adjusting means.

In the conventional yarn tension device described above, the moving yarn passes between the receiving plate and the pushing plate. Therefore, yarn dust such as lint adheres to the contacting surfaces of the receiving plate and the pushing plate. Further, for example, with yarn for knitting socks coated by a wax, when the moving yarn passes between the moving plate and the pushing plate and frictionally rubs thereagainst, wax adheres to the contacting surfaces.

Wax adheres to the contacting surfaces and gradually accumulates, disturbing the smooth moving of the yarn. Moreover, under this condition, a tension which is larger than the predetermined tension is applied to the yarn. As a result, this phenomenon leads to the yarn breaking or yarn disarrangement of the sock to be knitted. Further, in this condition, when a front yarn and a rear yarn are knitted, there is a danger of the surface yarn and the back yarn being reversely knitted (defective plating).

Therefore, in conventional devices, frequent maintenance is required to clean the contact surfaces of the receiving plate and the pushing plate.

However, because the knitting or weaving machine receives numerous yarn and the number of yarn devices is the same as the number of yarns, when a cleaning operation is carried out on all the yarn tension devices, a lot of work and a long time are required. Further, the knitting machine must be stopped during the cleaning operation, and productivity is deteriorated.

SUMMARY OF THE INVENTION

In view of the above-mentioned problems, an object of the present invention is to provide a yarn tension device free from maintenance.

According to a first aspect of the present invention, there is provided a yarn tension device having a receiving plate and a pushing plate for clamping a yarn and a spring for urging the pushing plate toward the receiving plate, characterized in that at least one of said receiving plate and said pushing plate is rotatably supported, add a drive source drives the rotatably supported receiving plate and/or pushing plate.

Therefore, lint or wax does not adhere to and accumulate between the contact surfaces of the receiving plate and the pushing plate, enabling self-cleaning. As a result, it is possible to provide a maintenance-free yarn tension device which does not require conventional manual cleaning.

According to a second aspect of the present invention, the pushing plate is unrotatably fixed the receiving plate is rotatably supported, and the drive source drives said receiving plate. In this case, the pushing plate does not follow the rotation of the driven receiving plate. Therefore, the self-cleaning operation described above is ensured.

According to a third aspect of the present invention, the receiving plate is unrotatably fixed the pushing plate is rotatably supported, and the drive source drives the pushing plate. In this case there is no danger of the receiving plate being rotated along with the rotation of the driven pushing plate.

According to a fourth aspect of the present invention, the receiving plate and the pushing plate are rotatably supported and the drive source drives the receiving plate and the pushing plate in opposite directions. Thus, lint or wax adhering to the contact surface between the receiving plate and the pushing plate is well scraped off by receiving a frictional rubbing generated by rotating the receiving plate and the pushing plate in opposite directions from each other.

According to a fifth aspect of the present invention, the receiving plate and the pushing plate are rotatably supported and the drive source drives the receiving plate and the pushing plate in the same direction at different rotational speeds. In this case, the lint or wax adhering to the contact surfaces of the receiving plate and the pushing plate is well removed and scraped off from the receiving and pushing plates.

BRIEF DESCRIPTION OF THE DRAWINGS

FIG. 2*a* shows a first version of the first embodiment and FIG. 2*b* shows a second version of the first embodiment;

FIG. 7*a* shows a first drive path, and FIG. 7*b* shows a second drive path;

FIG. 8*a* shows a first drive path, and FIG. 8*b* shows a second drive path.

DETAILED DESCRIPTION OF THE PREFERRED EMBODIMENTS

Preferred embodiments will now be described with reference to the accompanying drawings.

First Embodiment

Figure 1:
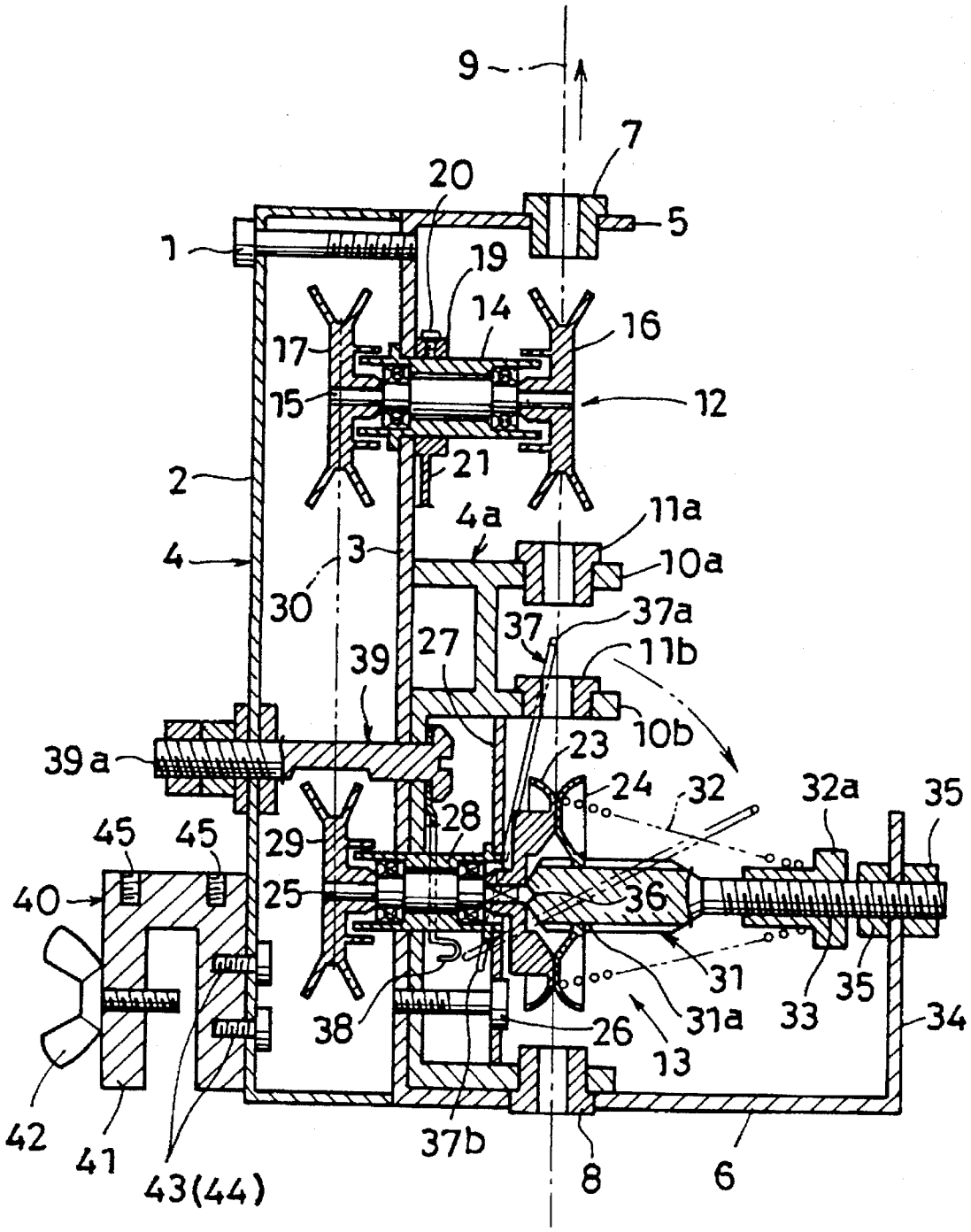
FIG. 1 is a vertical sectional side view showing a yarn tension device of a first embodiment of the present invention.
Figure 2A:
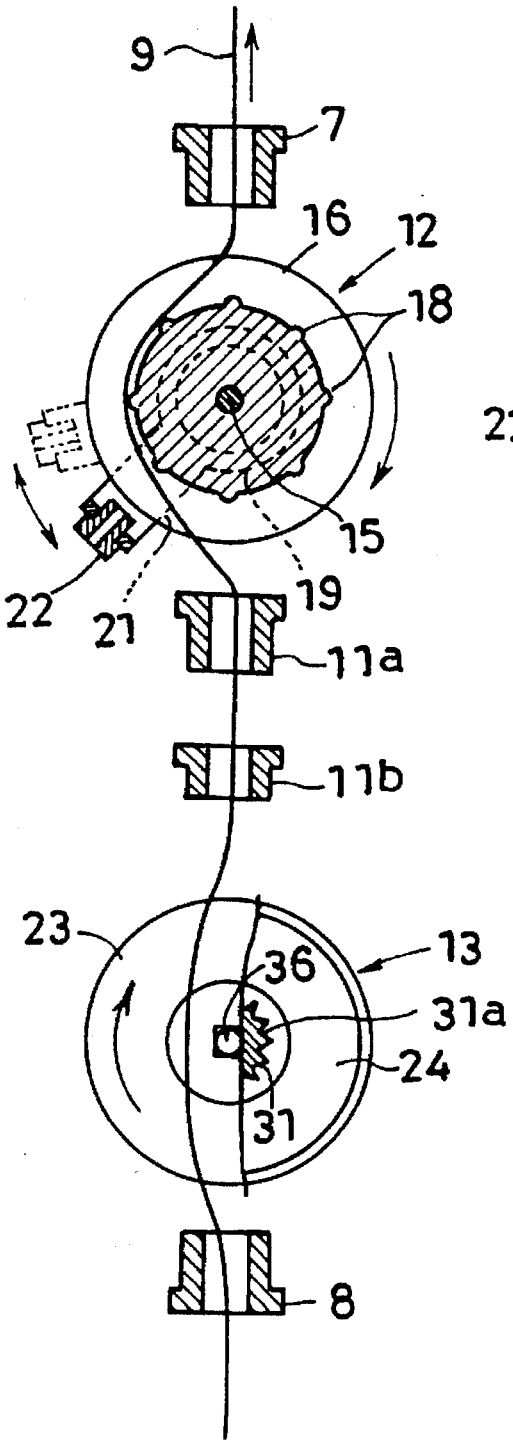
FIGS. 2*a* and 2*b* are vertical sectional views of the yarn tension device of the first embodiment of the present invention from a front side thereof.
Figure 2B:
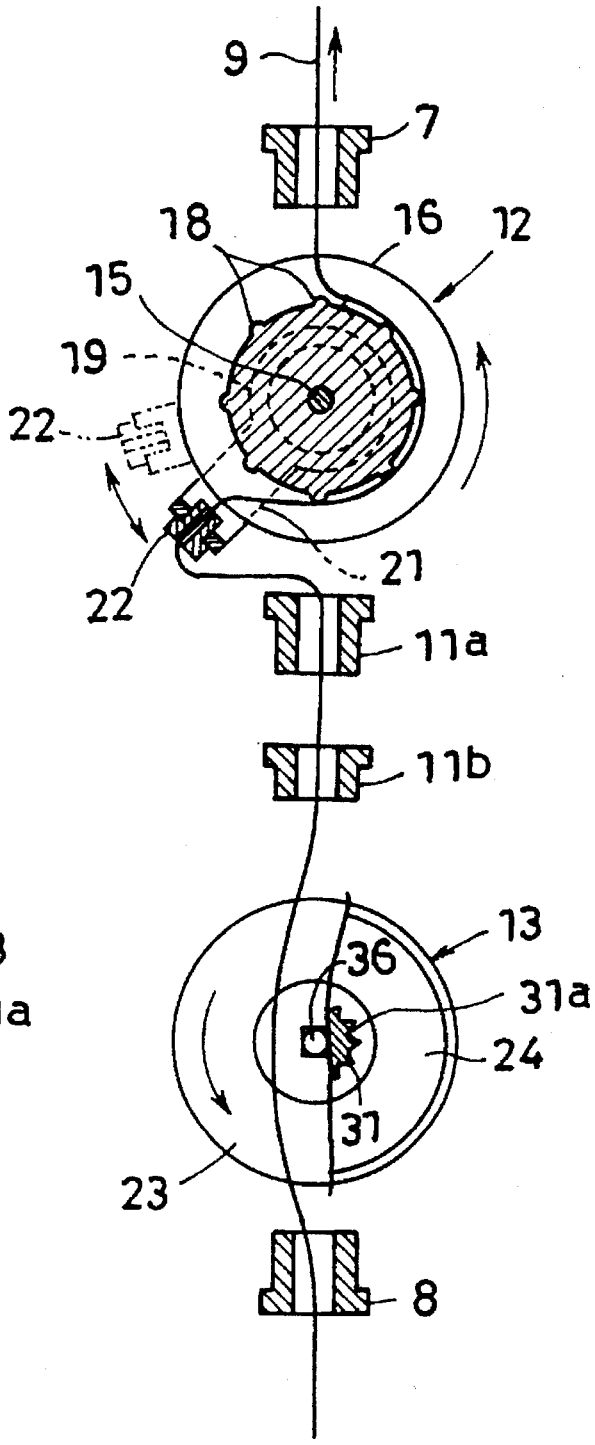

FIGS. 1 and 2*a* and 2*b* show a first embodiment of the present invention.

As shown in FIG. 1, a housing 4 comprises a back plate 2 and a front plate 3 detachably jointed together by a bolt 1. A mount base 4*a* is detachably fixed to the front plate 3.

The front plate 3 further includes upper and lower brackets 5 and 6 having upper and lower annular guides 7 and 8 respectively, forming a yarn path through which a yarn 9 passes. That is, the, yarn 9 is sent from a bobbin and travels through the lower annular guide 8 and the upper annular guide 7 in that order. After that, the yarn 9 is sent to a knitting machine.

A middle guide is mounted on a middle bracket which is mounted on the mount base 4*a* and forms the yarn path between the lower and the upper annular guides 7 and 8. In the embodiment shown in FIGS. 1 and 2*a* and 2*b*, the middle bracket comprises an upper and lower pair of middle brackets 10*a* and 10*b*. The middle guide is composed of annular middle guides 11*a* and 11*b* mounted on the upper and lower brackets 10*a* and 10*b* respectively.

A drive mechanism 12 is positioned between the upper annular guide 7 and the middle guide, and a tension mechanism 13 disposed between the annular middle guide and the lower guide 8.

The drive mechanism 12 includes a drive shaft 15 rotatably supported by a bearing in a bush 14 fitted in the surface plate 3 and outer and inner wheels 16 and 17 fixed to the ends of the drive shaft 15. The outer wheel 16 is positioned between the upper guide 7 and the middle guide and the center axis of the outer wheel 16 is positioned on the yarn path between the upper guide 7 and the annular middle guide and the center axis of the outer wheel 16 is perpendicular to the yarn path between the upper guide 7 and the middle guide. The inner wheel 17 is positioned in the housing 4.

As shown in FIGS. 2*a* and 2*b*, the inner and outer wheels 16 and 17 each have a V-shaped groove around the circumferential surface thereof and a plurality of projections 18 uniformly spaced around the bottom portion of the V-shaped groove in the circumferential direction.

A ring 19 is rotatably fitted on the bush 14 and is fixed by a set bolt 20. As shown in FIGS. 2*a* and 2*b*, an arm 21 extends from the ring 19 in a radial direction and has an adjustment guide 22 on a bent-over tip portion thereof.

The tension mechanism 13 includes receiving and pushing plates 23 and 24 for clamping the yarn 9 between the middle guide and the lower guide 8.

In order to make the receiving plate 23 rotatable a driven shaft 25 is provided. That is, a bush 28 is inserted through the front plate 3, the mount base 4*a* and a cover plate 27 which is detachably fixed to the mount base 4*a* by a bolt 26. The driven shaft 25 is rotatably supported in the bush 28 by way of bearing, and a driven wheel 29 and the receiving plate 23 are fixed to the ends of the driven shaft 25.

The driven wheel 29 is disposed in the housing 4. An endless transmitting means 30 is strung around the inner wheel 17 of the drive mechanism 12 and the driven wheel 29.

The receiving plate 23 is fixed on a rectangular shaft portion at an end portion of the driven shaft 25 in such a manner that the center axis of the receiving plate 23 is positioned on the yarn path between the middle guide and the lower guide 8 and the center axis of the receiving plate 23 is perpendicular to the yarn path between the middle guide and lower guide 8.

On the other hand, the pushing plate 24 is fitted on a fixed shaft 31 by way of a spline 31*a* and is unrotatable in the circumferential direction of the fixed shaft 31 but is slidable in the axial direction of the fixed shaft 31. The pushing plate 24 with respect to an axial direction of the fixed shaft 31. The pushing plate 24 is elastically pressed toward the receiving plate 23 by the spring 32. That is, the fixed shaft 31 is disposed concentrically with the driven shaft 25, one end of the fixed shaft 31 has a screw portion 33 which is detachably fixed to an erect portion 34 of the lower bracket 6 by a pair of lock nuts 35, and the other end of the fixed shaft 31 abuts against the end of the driven shaft 25. An abutting portion 36 is constituted by a cone-shaped sharp end portion provided at the shaft end portion of the driven shaft 25 and a cone shaped recess portion provided at the end of the fixed shaft 31. The cone-shaped sharp end portion is inserted into the cone shaped recess portion to rotatably connect the driven shaft 25 with respect to the fixed shaft 31.

A spring receiver 32*a* is screwed on the screw portion 33 of the fixed shaft 31 movably in the axial direction of the fixed shaft 31. A compression spring 32 is mounted between the spring receiver 32*a* and the receiving plate 24 so that the urging force of the spring 32 can be adjusted by moving the spring receiver 32*a* on the screw portion 33 forwardly and backwardly with respect to the axis of the fixed shaft 31.

A yarn break detecting lever 37 is provided in vicinity of the annular middle guide and mounted on the mount base 4*a* pivotally about a horizontal axis. When the yarn runs on the yarn path defined by the plurality of guides described above in a normal condition, the yarn break detecting lever 37 stands up as shown by a solid line in FIG. 1. If the yarn, breaks the yarn break detecting lever pivots downward under its own weight as shown with a dotted line in FIG. 1. For this, a detecting portion 37*a* contacting the yarn 9 is provided at a tip portion of the yarn break detecting lever 37 and an operating portion 37*b* is provided the base end thereof. A switch contact 38 is positioned in the vicinity of the base end of the yarn break detecting lever 37 in such a manner that when the detecting lever 37 pivots downward when the yarn 9 breaks, the operating portion 37*b* makes contact with the switch contact 38 and shortcircuits it. The switch contact 38 is connected to a terminal bolt 39. A terminal portion 39*a* of the terminal bolt 39 projects from the back plate 2 and by way of a cable (not shown) stops the drive source driving the yarn.

Mounting means 40 is mounted on the back plate 2. The mounting means comprises a U-shaped metal member 41 and a clamper 42 such as a butterfly bolt for clamping the U-shaped member 41 to a frame of the knitting or weaving machine or the like. In this embodiment, the U-shaped member 41 is mounted by screwing bolts 44 into screw holes 43 provided in a side surface of the U-shaped member 41 from the inner side of the back plate 2. The U-shaped member 41 also includes screw holes 45 on the top surface thereof. As a result, as shown in FIG. 1, the screw holes 43 can face the back plate 2 so as to position the opening portion of the U-shaped member facing downward or the opening portion of the U-shaped member can be oriented transversely by facing the screw holes 45 to the back plate 2.

The yarn tension device of the first embodiment of the present invention is used by mounting it to a desired portion such as the frame of the knitting or weaving machine with the mounting means 40.

In the first embodiment, as shown in FIG. 2*a*, the yarn 9 passes through the lower guide 8, between the receiving plate 23 and the pushing plate 24, and through the annular middle guides 11*b* and 11*a*, and passes around on the outer wheel 16. Finally, the yarn is pulled out through the upper annular guide 7. At this time, in the tension mechanism 13, a clamping force applied between the receiving plate 23 and the pushing plate 24 is determined by adjusting the urging force of the spring 23 using the spring receiver 32*a* so that a predetermined tension is applied to the moving yarn 9.

When the outer wheel 16 is driven and rotated by the yarn 9, the receiving plate 23 is driven and rotated by a rotation force transmitted through the transmitting path made up of the drive shaft 15, the inner wheel 17, the transmitting means 30, the driven wheel 29 and the driven shaft 25. In contrast, the pushing plate 24 does not rotate along with the rotation of the receiving plate 23 because the pushing plate 24 is unrotatably fixed to the fixed shaft 31 by way of the spline 31*a*, as described above.

In connection with this point, if that the pushing plate 24 is rotatably supported on the fixed shaft 31 without the spline 31*a* being provided and is elastically contacted to the receiving plate 23 by the spring 32, the pushing plate 24 is stopped and is not rotated along with the rotation of the receiving plate 23 under a relatively low tension. However, when the elastically urging force of the spring 23 is increased by adjusting the spring receiver 32*a*, there is a danger of the pushing plate 24 being rotated along with the receiving plate 23 by strongly contacting the pushing plate 24 to the receiving plate 23. However, according to the first embodiment of the present invention, the pushing plate 24 is unrotatably fixed by way of the spline 31*a* so that the pushing plate 24 is not rotated along with the pushing plate 23 when the elastically urging force of the spring 32 is increased.

As a result, lint or wax adhering to the contact surface between the receiving plate 23 and the pushing plate 24 is always scraped off, since rotating receiving plate 23 makes contact with the unrotatably pushing plate 24 so as to frictionally rub the contacting surfaces. As a result, lint or the wax does not adhere to and accumulate between the contact surfaces.

In a second version of the first embodiment of the present invention shown in FIG. 2*b*, the yarn 9 passes through the annular middle guides 11*a* and 11*b* and the adjustment guide 22, and then the yarn 9 passes around the outer wheel 16 and is guided out through the upper guide 7. Otherwise the structure is the same as that of the first version shown in FIG. 2*a*.

It is possible to adjust the position of the adjustment guide 22 in the circumferential direction with respect to the bush 14 by loosening the set bolt 20 and rotating the ring 19 as shown with a dotted line in FIG. 2*b*. The adjustment guide 22 is thus set to the most suitable position.

By the yarn path directed to the out wheel 16 being rerouted by the adjustment guide 22, it is possible to elongate the portion of the yarn 9 strung around the outer wheel 16. As a result the moving force of the yarn 9 is surely transmitted to the outer wheel 16 and the yarn 9 can be prevented from slipping with respect to the outer wheel 16.

Second Embodiment

The composition of the apparatus according to a second embodiment is essentially the same as that of the apparatus according to the first embodiment, except for the tension mechanism 13. Therefore, the reference numerals denote the same members of the first embodiment of the present invention and a detailed description is omitted.

Figure 3:
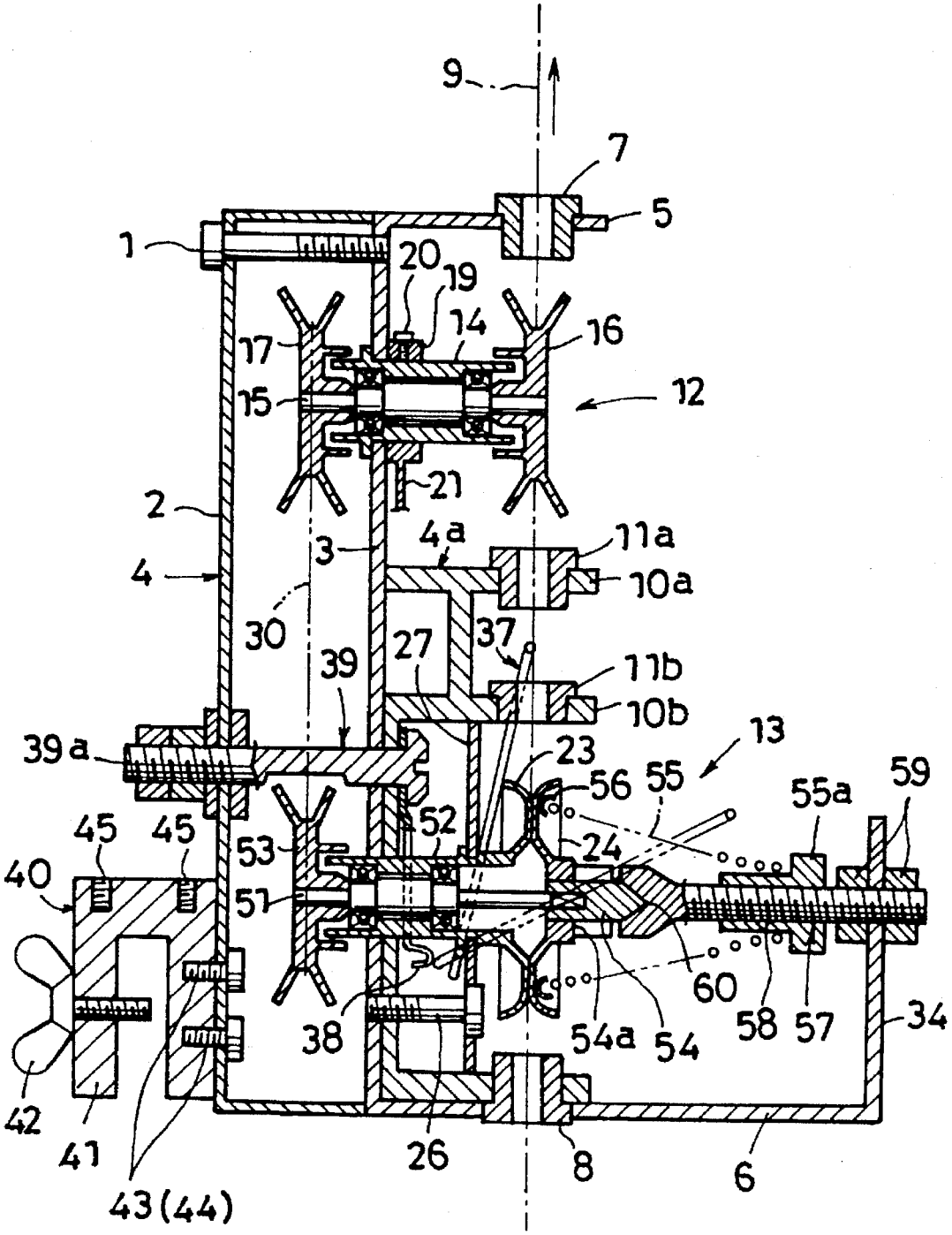
FIG. 3 is a vertical sectional side view showing a second embodiment of the present invention.
Figure 4:
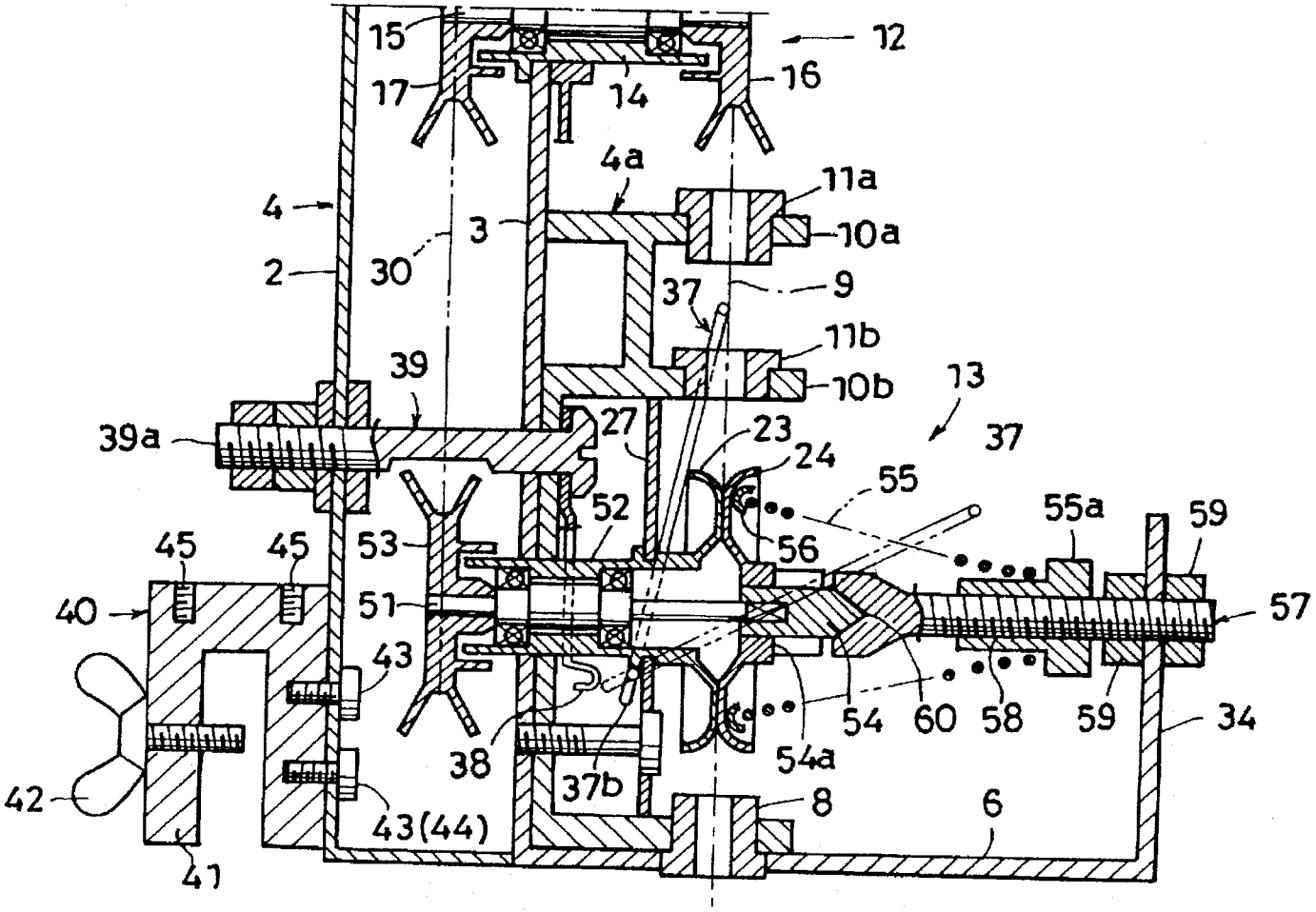
FIG. 4 is an enlarged sectional view showing a yarn tension device of a second embodiment of the present invention.

FIGS. 3 and 4 show the second embodiment of the present invention. The tension mechanism 13 comprises the receiving plate 23 and the pushing plate 24 for clamping the yarn 9 between the middle guide and the lower guide 8, but the receiving plate 23 is unrotatably fixed and the pushing plate 24 is rotatably supported and is rotated by a drive force obtained from the driving mechanism 12.

In order to rotate the pushing plate 24, there is provided a driven shaft 51. Namely, a bush 52 passes through the front plate 3, the mount base 4*a* and the cover plate 27. The driven shaft 51 is rotatably supported in the bush 52 by way of a bearing, and the driven wheel 53 is fixed to one end of the driven shaft 51 and the pushing plate 24 is mounted on the other end of the driven shaft 51 by way of a rotary shaft 54.

The driven wheel 53 is disposed inside the housing 4. The endless transmitting means 30 is strung between the inner 15 wheel 17 of the drive mechanism 12 and the driven wheel 29. In this point, the structure of the second embodiment is the same as that of the first embodiment.

In the receiving plate 23, the center axis thereof is positioned on the yarn path between the middle guide and the lower guide 8 and the center axis of the receiving plate 23 is perpendicular to the yarn path between the middle guide and lower guide 8. The receiving plate 23 is fixed to the bush 52 in such a manner that, for example, the receiving plate 23 is fitted onto an extension portion of the bush 52 and is secured by a set bolt or the like.

A rotary shaft 54 is fitted on a rectangular shaft portion at an end portion of the driven shaft 51. The pushing plate 24 is unrotatably fixed to the rotary shaft 54 by way of a spline 54*a* but is slidable in the axial direction of the rotary shaft 54. The pushing plate 24 is elastically pushed toward the receiving plate 23 by a spring 55. At this time, in order to allow relative rotation between the end portion of the spring 55 and the pushing plate 24, a rotationally sliding ring 56 is mounted on the end portion of the spring 55. As a result, the pushing plate 24 rotates while slipping in contact with the surface of the rotationally sliding ring 56.

The spring 55 is supported by a fixed shaft 57. The fixed shaft 57 is concentric with the rotary shaft 54. One end of the fixed shaft 57 has a screw portion 58 which is detachably fixed to the erect portion 34 of the lower bracket 6 by a pair of lock nuts 59, and the other end of the fixed shaft 57 abuts against an end portion of the rotary shaft 54. This abutting portion 60 is constituted by a cone-shaped sharp end portion provided at the end portion of the rotary shaft 54 and a cone-shaped recess portion provided at the end of the fixed shaft 57. The cone-shaped sharp end portion is inserted into the cone shaped recess portion to rotatably connect the rotary shaft 54 with respect to the fixed shaft 57.

A spring receiver 55*a* is screwed to a screw portion 58 of the fixed shaft 57 movably in the axial direction of the fixed shaft 57. The compression spring 55 is mounted between the spring receiver 55*a* and the pushing plate 24 and the elastically urging force of the spring 55 is adjusted by moving the spring receiver 55*a* on the screw portion 58 forwardly and backwardly with respect to the axis of the fixed shaft 57.

In the second embodiment of the present invention also, it is possible to use the yarn path shown in FIGS. 2*a* and 2*b*. In any case, in the tension mechanism 13, the clamping force applied between the receiving plate 23 and the pushing plate 24 can be determined by adjusting the urging force of the spring 55 by means of the spring receiver 55*a* so that a predetermined tension is applied to the moving yarn 9.

When the moving yarn 9 serves as a driving force operating the driving mechanism 12, the driven shaft 51 is rotated along with the driven wheel 53 and rotates the rotary shaft 54, and the pushing plate 24 rotates in pressed contact with the receiving plate 23. Here, because the receiving plate 23 is unrotatably fixed it does not rotate along with the rotation of the pushing plate 23.

As a result, lint or wax adhering to the contact surface between the receiving plate 23 and the pushing plate 24 is always scraped off, since the rotating pushing plate 24 makes contact with the unrotatable receiving plate 23 and frictionally rubs the contacting surfaces, and lint or wax does not adhere to and accumulate between the contact surfaces of the receiving plate 23 and the pushing plate 24.

Third Embodiment

Figure 5:
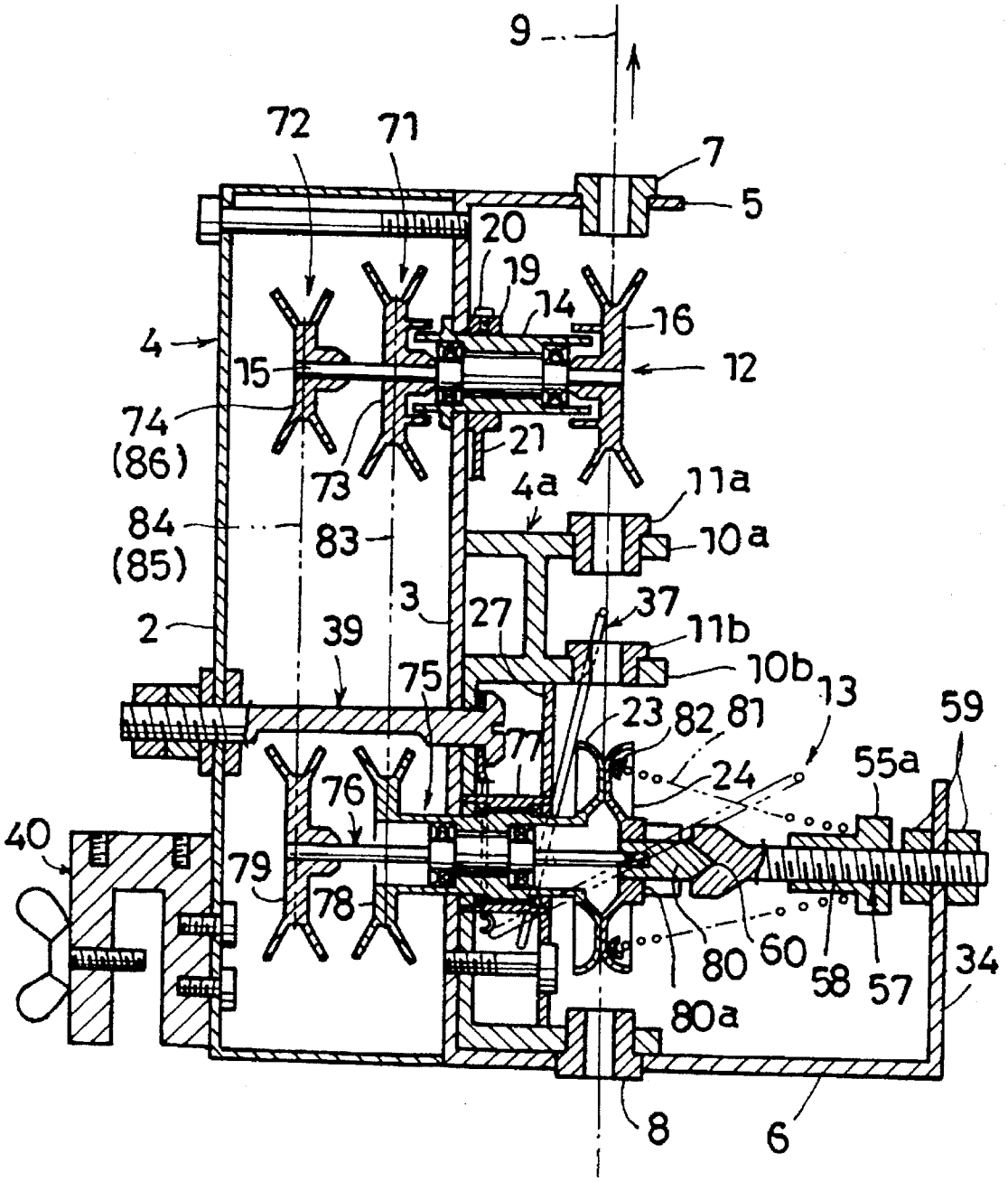
FIG. 5 is a vertical sectional side view showing a yarn tension device of a third embodiment of the present invention.
Figure 6:
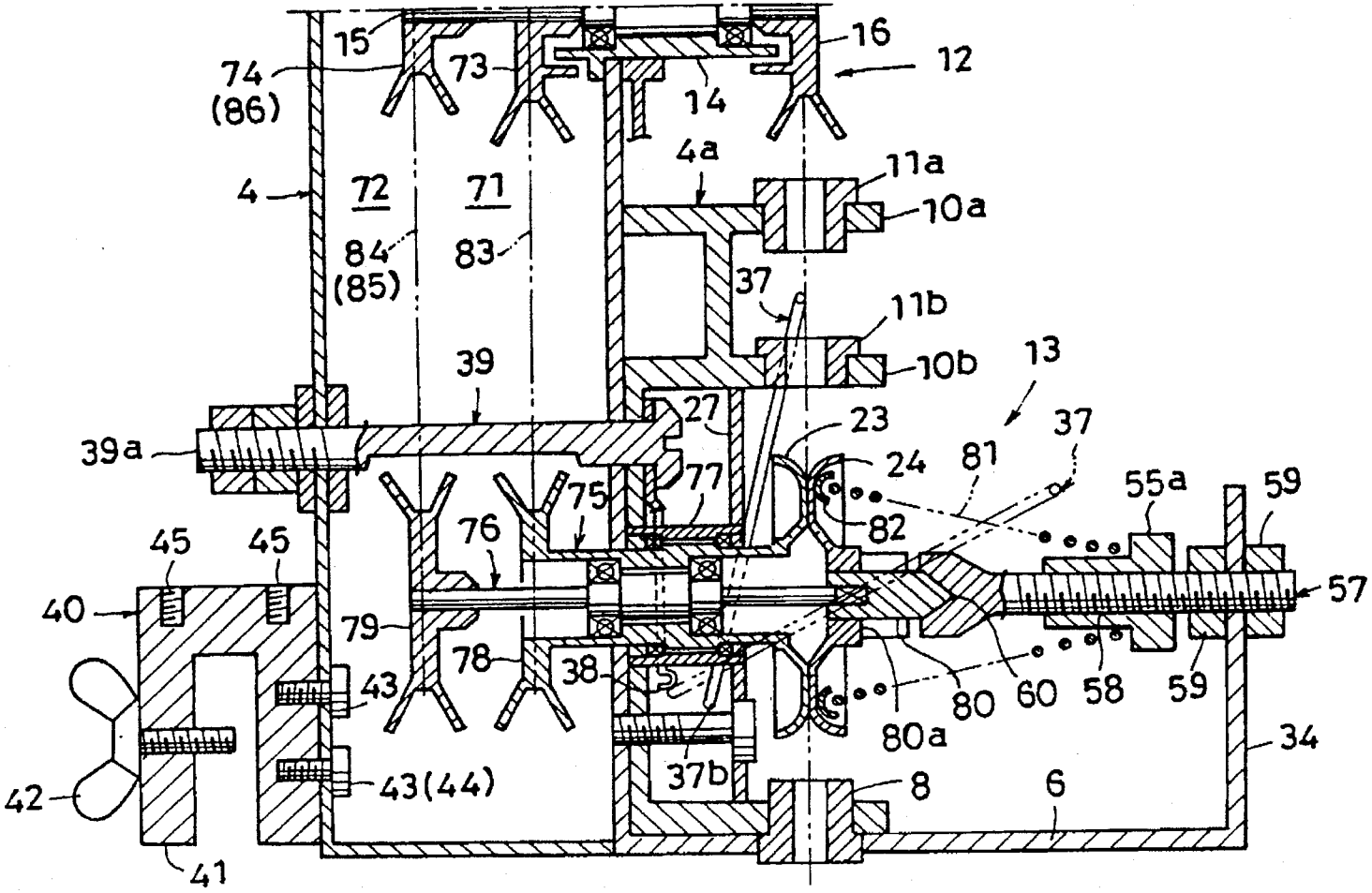
FIG. 6 is an enlarged sectional view showing the third embodiment of the present invention.

FIGS. 5 to 7 show a third embodiment of the present invention. The composition of the apparatus according to a third embodiment is essentially the same as that of the apparatus according to the first embodiment, except for the drive mechanism 12 and the tension mechanism 13. Therefore, the reference numerals denote the same members of the first embodiment of the present invention as shown in FIGS. 1 and 2 and their detailed description is omitted.

In the third embodiment of the present invention, the tension mechanism 13 includes the receiving plate 23 and the pushing plate 24 for clamping the yarn 9 between the middle guide and the lower guide 8. The receiving plate 23 and the pushing plate 24 are each rotatably supported. There is provided a drive source for rotating the receiving and pushing plates 23 and 24 in different rotating directions, so that the rotating direction of the receiving plate 23 is opposite to the rotating direction of the pushing plate 24.

To effect this, a first drive path 71 for rotating the receiving plate 23 and a second drive path 72 for rotating the receiving plate 24 are constituted between the drive mechanism 12 and the tension mechanism 13.

The drive mechanism 12 includes the drive shaft 15 rotatably supported by way of a bearing in the bush 14 passing through the front plate 3 and the outer and the inner wheel 16 and 17 mounted on the ends of the drive shaft 15. The outer wheel 16 is positioned between the upper guide 7 and the middle guide and the center axis of the outer wheel 16 is positioned on the yarn path between the upper guide 7 and the annular middle guide. This arrangement is the same as the first embodiment of the present invention. However, the third embodiment is different from the first embodiment as follows: In the housing 4, a first inner wheel 73 and a second inner wheel 74 are fixed to the drive shaft 15; the first inner wheel 73 constitutes a drive source for the receiving plate 23 and the second inner wheel 74 constitutes a drive source for the pushing plate 24.

The tension mechanism 13 includes a tubular first driven shaft 75 for rotating the receiving plate 23 and a second driven shaft 76 for rotating the pushing plate 24.

The first driven shaft 75 passes through and is rotatably supported by way of a bearing in a bush 77 mounted between the mount base 4*a* and the cover plate 27. The receiving plate 23 is fixed on the outer end of the first driven shaft 75 and a first driven wheel 78 is fixed to the inner end thereof positioned in the housing 4.

The second driven shaft 76 passes through and is rotatably supported by way of a bearing in the first driven shaft 75. A second driven wheel 79 is fixed to the inner end of the second driven shaft 76 positioned in the housing 4.

The pushing plate 24 is mounted on the outer end of the second driven shaft 76 by way of a rotary shaft 80 concentrically connected to the second driven shaft 76. The rotary shaft 80 is fitted on a rectangular shaft portion at an end portion of the second driven shaft 76. The pushing plate 24 is fitted on the rotary shaft 80 by way of a spline 80*a* and the pushing plate 24 is unrotatable in the circumferential direction of the rotary shaft 80 but is slidable in the axial direction of the rotary shaft 80.

The pushing plate 24 is elastically pressed toward the receiving plate 23 by a spring 81. At this time, in order to allow relative rotation between the end portion of the spring 81 and the pushing plate 24, a rotationally sliding ring 82 is mounted on the end portion of the spring 81. As a result, the pushing plate 24 rotates while slipping in contact with the surface of the rotationally sliding ring 82.

The spring 81 is supported by the fixed shaft 57. A spring receiver 55*a* is screwed on the screw portion 58 of the fixed shaft 57 forwardly and backwardly movable with respect to the axis of the fixed shaft 57 so as to allow adjustment of the elastically urging force of the spring 81. The structure of the fixed shaft 57 is the same as the second embodiment of the present invention so that the reference numerals denote the same numbers shown in FIGS. 3 and 4 and the detailed description is omitted.

In the first drive path 71, endless first transmission means 83 and second transmission means 84 are strung around the first inner wheel 73 and the first driven wheel 78 and between the second inner wheel 72 and the second driven wheel 79 respectively, so as to rotate the receiving plate 23 and the pushing plate 24 respectively.

In the third embodiment, in order to rotate the receiving plate 23 and the pushing plate 24 in opposite directions from each other, converting means for converting the rotational direction is provided in either the first drive path 71 or the second drive path 72.

Figure 7A:
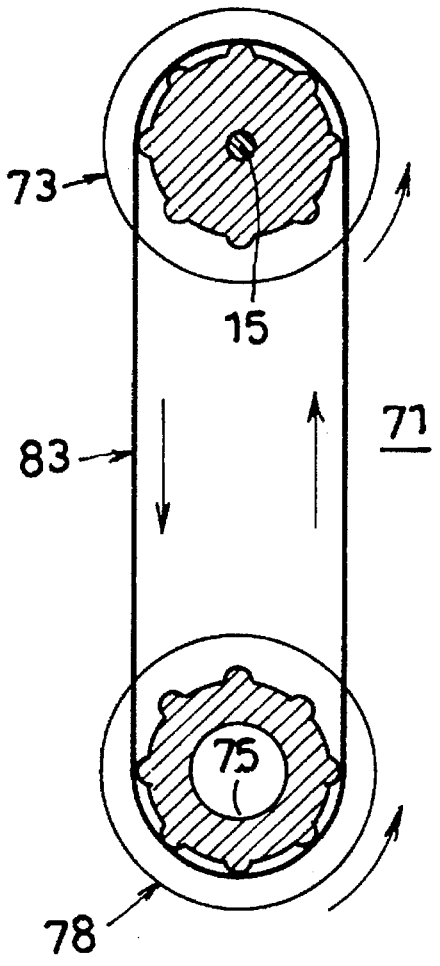
FIGS. 7*a* and 7*b* are vertical sectional views of drive paths of the yarn tension device of the third embodiment from a front side thereof.
Figure 7B:
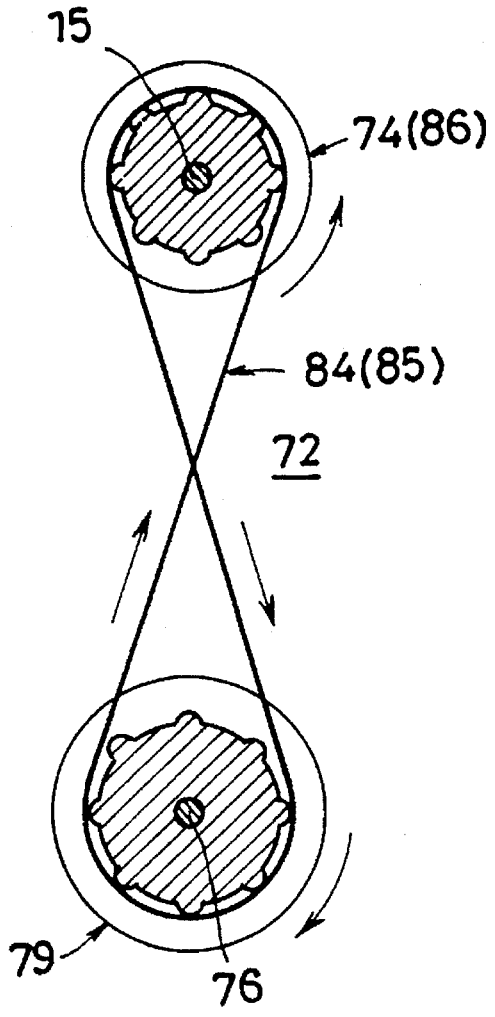

As shown in FIG. 7*a*, in the first drive path 71, the first transmitting means 83 transmits the rotational drive of the first inner wheel 73 to the first driven wheel 78 in the same rotation direction of the first inner wheel 73 without converting the rotation direction. On the other hand, in the second drive path 72 shown in FIG. 7*b*, the second transmitting means 84 is strung in a figure eight around the second inner wheel 74 and the second driven wheel 79 so that there is provided a rotation direction converting means 85 which is capable of transmitting the rotational drive to the first driven wheel 78 in the opposite direction to the original rotation direction. Thus, the receiving plate 23 rotates in a forward direction and the pushing plate 24 rotates in a backward direction.

It is possible to form the first inner wheel 73 and the first driven wheel 78 constituting the first drive path 71 or the second inner wheel 74 and the second driven wheel 79 constituting the second drive path 72 with the same diameter, or the wheels may be given different diameters from each other in order to form a speed reduction means. In FIGS. 5 to 7, the second inner wheel 74 only is smaller in a diameter than the other wheels. In this structure, speed reduction means 86 is provided in the second drive path 72. Thus, the rotational speed of the pushing plate 24 is slower than that of the receiving plate 23. The speed reduction means 86 may be applied to one or a plurality of the wheels described above. It is possible to design the speed reduction means 86 in order to obtain the best conditions for scraping off lint or wax adhering to the contact surface between the receiving plate 23 and the pushing plate 24.

In the third embodiment of the present invention also, it is possible to use the yarn paths shown in FIGS. 2*a* and 2*b*. In this case, the urging force of the spring 81 is adjusted by the spring receiver 55*a* so that the predetermined tension is applied to the moving yarn 9 clamped between the receiving and the pushing plate 23 and 24.

When the moving yarn 9 serves as the drive source for operating the driving mechanism 12, the pushing plate 24 is pressingly contacted to the receiving plate 23 by way of the first and second drive paths 71 and 72 so that the receiving and pushing plates 23 and 24 rotate in opposite directions from each other. As a result, lint or wax adhering to the contact surfaces of the receiving and pushing plates 23 and 24 is always scraped, off and does not adhere to and accumulate between the contact surfaces, since the receiving and the pushing plate 23 and 24 slidably rotate in opposite directions from each other so as to frictionally rub the contacting surfaces of the receiving and pushing plates 23 and 24.

Fourth Embodiment

Figure 8A:
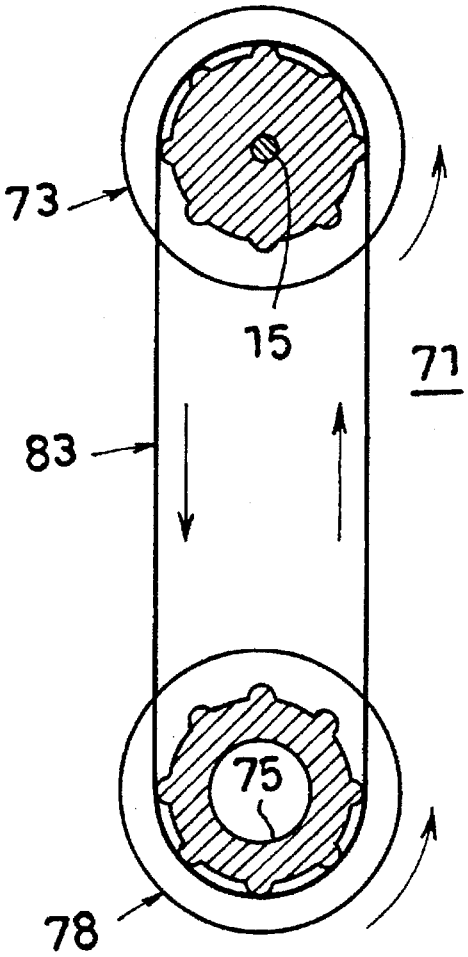
FIGS. 8*a* and 8*b* are vertical sectional views of drive paths of the yarn tension device of a fourth embodiment from a front side thereof.
Figure 8B:
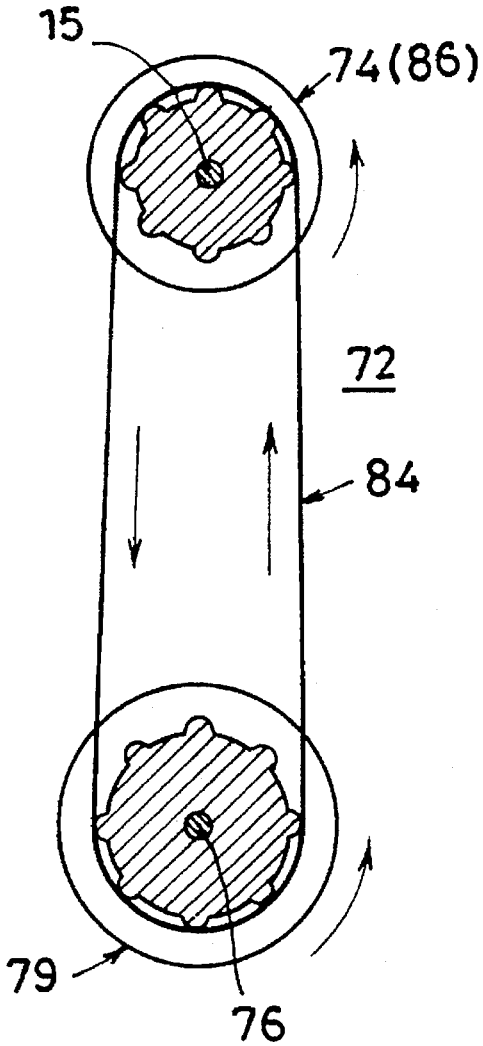

A fourth embodiment of the present invention is basically the same as the third embodiment of the present invention. Thus, FIG. 5 shows the substantial structure of the fourth embodiment. However, the fourth embodiment is not provided with the rotation direction converting means 85 described in the third embodiment. Namely, as shown in FIGS. 8*a* and 8*b*, in the first drive path 71, the first transmitting means 83 transmits the rotational drive of the first inner wheel 73 to the first driven wheel 78 in the same rotational direction as the first inner wheel 73 without converting the original rotational direction.

In the same manner, in the second drive path 72, the second transmitting means transmits the rotational drive of the second inner wheel 74 to the second driven wheel 79 in the same direction without switching the rotational direction.

However, in the fourth embodiment of the present invention, there is still provided the speed reduction means 86 described in the third embodiment. Therefore, although the receiving plate 23 and the pushing plate 24 rotate in the same direction, it is possible to make their rotational speeds differ.

As a result, when the moving yarn 9 serves as the drive source operating the driving mechanism 12, the pushing plate 24 is pressingly contacted to the receiving plate 23 by way of the first and second drive paths 71 add 72 so that the receiving plate 23 and the pushing plate 24 rotate with different rotation speeds from each other. As a result, lint or wax adhering to the contact surface between the receiving plate 23 and the pushing plate 24 is scraped off and does not adhere to and accumulate between the contact surfaces, because the pushing plate 24 makes slipping contact with the receiving plate 23 due to the difference in speed between the two plates.

The present invention is of course not limited to the embodiments described above. It is possible to make various design changes based on the spirit of the invention described in the scope of the claims. For example, in each preferred embodiment, the driving mechanism is driven by the moving force of the yarn 9 to rotate the receiving plate 23 and/or the pushing plate 24; however, the present invention may employ one or plurality of independent driving sources such as an electric motor or the like to rotate the receiving plate 23 and/or the pushing plate 24.

According to the present invention, a yarn tension device includes pushing and receiving plates for clamping a moving yarn and a spring for urging the pushing plate toward the receiving plate; at least one of the plates is rotatable, and a drive source is provided for rotating the rotatable plate so that lint or wax adhering to the contact surfaces between the receiving plate 23 and the pushing plate 24 is always scraped off by frictional rubbing generated by relative rotation of the pushing and receiving plates 23 and 24. Therefore, lint or wax does not adhere to and accumulate between the contact surfaces of the receiving plate 23 and the pushing plate 24, and self-cleaning is possible. As a result, it is possible to provide a maintenance-free yarn tension device with which conventional cleaning is not necessary.

In another specific structure of the present invention, when the pushing plate 24 is made rotatable, the receiving plate 23 is unrotatably fixed. Thus, the receiving plate 23 does not rotate along with the rotation of the driven pushing plate 24. Alternatively, when the receiving plate 23 is rotatable, the pushing plate 24 is unrotatably fixed. Thus, the pushing plate 24 does not rotate along with the rotation of the driven receiving plate 23. Therefore, the above-mentioned advantages of the present invention described above are ensured.

In another specific structure of the present invention, the receiving and pushing plates rotate in opposite directions from each other. Thus, lint or wax adhering to on the contact surfaces between the receiving plate 23 and the pushing plate 24 is always well scraped off by receiving a frictional rubbing generated by rotating the receiving and pushing plates 23 and 24 in opposite directions from each other to provide a superior self-cleaning effect.

In another specific structure of the present invention, the receiving and pushing plates 23 and 24 rotate at different rotational speeds from each other in the same direction to produce the same self-cleaning effect.

What is claimed is:

1. A yarn tension device comprising a housing unit provided with a mounting means for mounting the unit to a portion such as a frame, a tension mechanism provided on the housing and positioned at an upstream path of a moving yarn, and a drive mechanism provided on the housing and positioned at a downstream path of the moving yarn, wherein;

said tension mechanism comprises a receiving plate and a pushing plate for clamping the yarn, and a spring for urging the pushing plate toward the receiving plate, at least one of said receiving plate and said pushing plate being rotatably supported;

said drive mechanism comprises a drive shaft, a wheel mounted on said drive shaft, and a transmitting means for transmitting a driving force from said drive shaft to said at least one rotatably supported plate, wherein said moving yarn, after passing through the tension mechanism, passes around the wheel for imparting said driving force to the wheel.

2. A yarn tension device according to claim 1, wherein the drive shaft is rotatably mounted on the housing adjacent to said downstream path of the yarn and provided at one end with said wheel and at the other end with an inner wheel; a driven shaft is rotatably mounted on the housing adjacent to said upstream path of the yarn and connected at one end to said one of the plates to be driven and provided at the other end with a driven wheel; wherein said transmitting means is provided between said inner wheel and said driven wheel so that said driving force may be transmitted from the inner wheel to the driven wheel.

3. The yarn tension device according to claim 1, wherein the receiving plate is unrotatably fixed and the pushing plate is rotatably supported and said driving mechanism transmits a driving force for rotating the pushing plate.

4. The yarn tension device according to claim 1, wherein the receiving plate and the pushing plate are rotatably supported and said driving mechanism transmits a driving force for rotating the receiving plate and the pushing plate in opposite directions from each other.

5. The yarn tension device according to claim 1, wherein the receiving plate and the pushing plate are rotatably supported and said driving mechanism transmits a driving force for driving the receiving plate and the pushing plate in the same direction at rotational speeds different from each other.

* * * * *